United States Patent [19]

Fischer et al.

[11] 4,136,324

[45] Jan. 23, 1979

[54] EXPANSION BOX TEMPERATURE REGULATOR FOR ELECTRIC APPLIANCES

[76] Inventors: Karl Fischer, Am Gaensberg; Manfred Schwarze, Rote-Tor-Strasse 53, both of 7519 Oberderdingen, Fed. Rep. of Germany

[21] Appl. No.: 722,317

[22] Filed: Sep. 10, 1976

[30] Foreign Application Priority Data

Sep. 11, 1975 [DE] Fed. Rep. of Germany ..... 2540499

[51] Int. Cl.[2] ..... H01H 71/18

[52] U.S. Cl. ..... 337/139; 337/390; 337/398

[58] Field of Search ..... 337/123, 124, 126, 131, 337/139, 383, 390, 393, 398

[56] References Cited

U.S. PATENT DOCUMENTS

| | | | |
|---|---|---|---|
| 3,134,003 | 5/1964 | Them | 337/398 X |
| 3,149,214 | 9/1964 | Weeks | 337/390 |
| 3,899,765 | 8/1975 | Daigneault | 337/390 X |

*Primary Examiner*—George Harris

*Attorney, Agent, or Firm*—J. Rodman Steele, Jr.

[57] ABSTRACT

An expansion box heat regulator for an electric cooker, using a switch housing containing both a control circuit snap switch and a mains switch in respective recesses in the housing, and permitting the switch terminals to be mounted on the housing to extend therefrom on each lateral side of the expansion box parallel with the axis of the box, thus providing a low-profile structure requiring minimal installation dimension in the axial direction of the expansion box.

12 Claims, 5 Drawing Figures

EXPANSION BOX TEMPERATURE REGULATOR FOR ELECTRIC APPLIANCES

Figure 1:
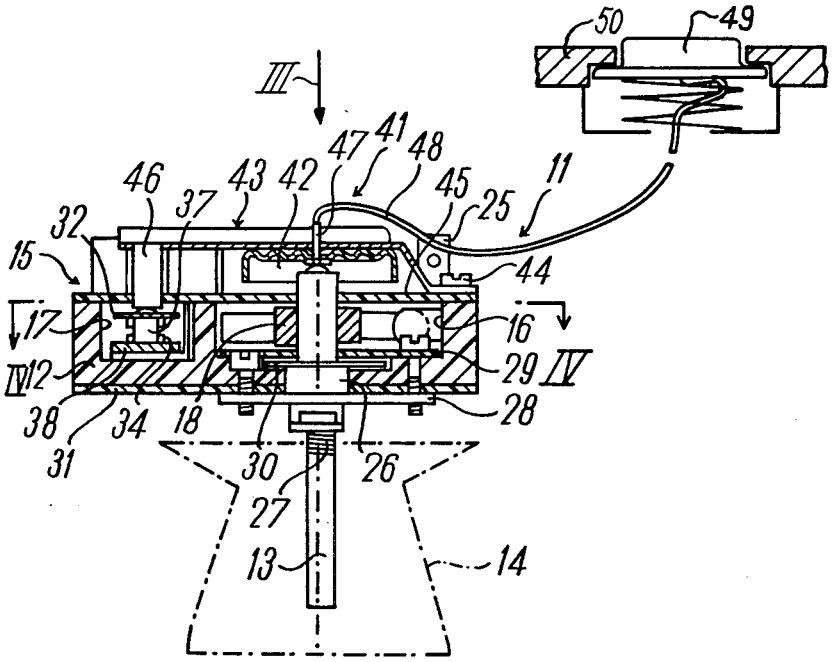

The present invention relates to an expansion box temperature regulator for an electrical appliance e.g. an electrical cooker.

Copending patent application Ser. No. 560,926, filed Mar. 21, 1975, now U.S. Pat. No. 4,038,613 by the present applicant, relates to a temperature regulator for electrical appliances, of the kind having an expansion box connected to a thermometer probe by a capillary tube, and having an adjustment member which acts upon one side of the expansion box, and a transmission lever disposed to be acted upon by the other side of the expansion box acts so as to operate a snap switch on expansion and contraction of the box. In the copending application, it is proposed that, in such a temperature regulator, the transmission lever extend closely above the expansion box and that the snap switch be disposed perpendicular to the longitudinal extension of the transmission lever.

The temperature regulator according to the copending application is a particularly simple construction of an adjustable hydraulic temperature regulator, and the expansion box, the snap switch and the transmission lever are located in a common housing whose rear side is closed by an insulating plate.

The present invention is particularly suitable for further improving the temperature regulator according to the copending application in its practical use, in particular in electrical heating and cooking appliances. More particularly it is an object of the present invention to provide a temperature regulator of low installation height.

There is provided by the present invention a temperature regulator for an electrical appliance which comprises an expansion box, the expansion box being connectible to a temperature sensor such as to vary the pressure in the box with the temperature sensed by the sensor; an adjustment member mounted to act on one side of the expansion box, a transmission lever mounted to be acted upon by the opposite side of the transmission box; a snap switch located to be acted upon, to cause switching thereof, by said transmission lever on expansion and contraction of the expansion box; the transmission lever extending closely over the expansion box; a cam switch for mains or signal line connection, the cam of which is operated by said adjustment member; and a switch housing; said snap switch and said cam switch being mounted within a recess formed in the switch housing and open at the side thereof adjacent the transmission lever, and the assembly formed by the expansion box and the transmission lever being of a height not substantially greater than the height of the housing and of a width in the direction transverse to the transmission arm substantially less than that of the switch housing.

In this manner, it is possible, while hardly altering the height of the installation, to include the function of a mains switch and signal line connection in the temperature regulator while in the invention of the copending application an accessory switch would be required for the mains connection, which would increase the installation height. By keeping the regulator part in the direction transverse to the transmission arm narrow there is no increase in installation volume and there is also a considerable width available in the switch housing part for the disposal of the snap switch.

This arrangement permits a particularly preferred embodiment wherein terminals are provided for the temperature regulator on the side of the housing part adjacent the transmission lever and in close proximity to the regulator part. These terminals are preferably male i.e. plugs. These plug terminals may be recessed spring plug terminals although plug lugs (so called AMP-plugs) are alternatively possible. Since these terminals are disposed next to the regulator part, they do not increase the installation height. There is a particular advantage in plug terminals having projecting plug lugs although it is also advantageous to provide recessed spring plug terminals or screw terminals because the terminal wires require a specific bending radius which in a conventional construction is also a determining factor for the installation height.

The switch housing may preferably be a flat member formed of insulating material, in which the snap switch and the cam switch are disposed each in a separate recess which is open towards the side adjacent the transmission lever. Thus, the regulator part mounted on the housing part may be covered by a by a separate insulating housing.

The expansion box preferably has a very small diameter. This is permitted in that, on the one hand, the transmission lever produces movement on the snap switch operating member, and, in that, on the other hand, as a result of the advantageous layout of the expansion box, transmission lever and the snap switch, only a small expansion is required for switching of the snap switch. Advantageously, the transmission lever, in the form of a leaf spring, exerts on the expansion box and the snap switch an initial stress which loads the snap switch in the direction to close the contacts thereof. The expansion box forms a temperature-dependent stop for the transmission lever which is adjustable by the adjustment member which may be in the form of a screw spindle.

The snap switch preferably has a snap spring on whose two ends contacts are disposed which switch at different temperatures and on which two opposed spring tongues are provided which are supported in fixed abutments to urge the spring end portions into contact with stop members, thus to locate the spring. Between the abutments is provided a pressure member of the snap spring upon which a pressure member of the transmission lever acts. A smaller construction for a snap switch has also been proposed in the German patent application No. P 24 22 684.4 of the present applicant whose disclosure is incorporated herein by reference. It is particularly suitable for the construction of the temperature regulator according to the invention since, having the minimu installation height and width, it enables process switching with minimum switching paths of 1/100 mm. The temperature regulator may therefore be constructed as a 2-circuit regulator to whose switching contacts two heating resistors of an electrical hot plate may be connected. These two-circuit regulators provide for a substantially smoother temperature regulation than a simple on-off regulator.

Figure 2:
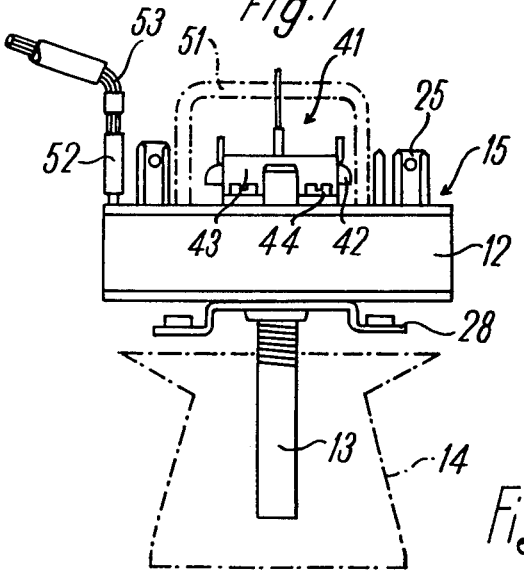
Figure 3:
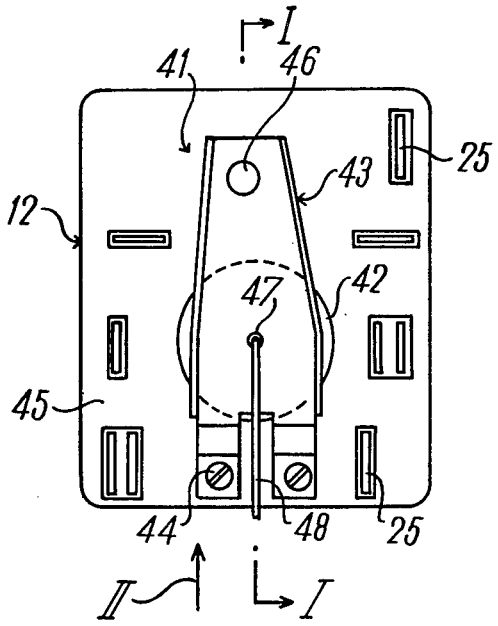
Figure 4:
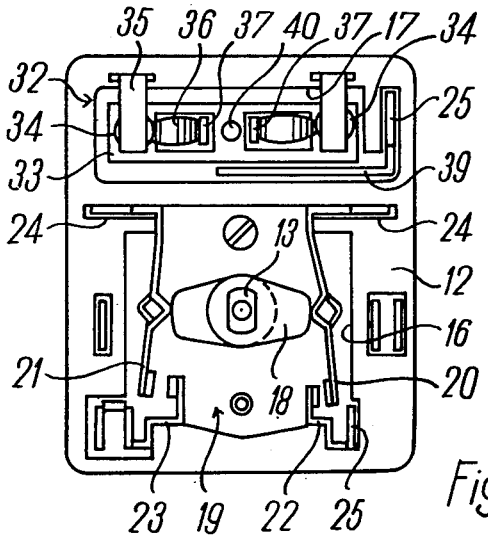
Figure 5:
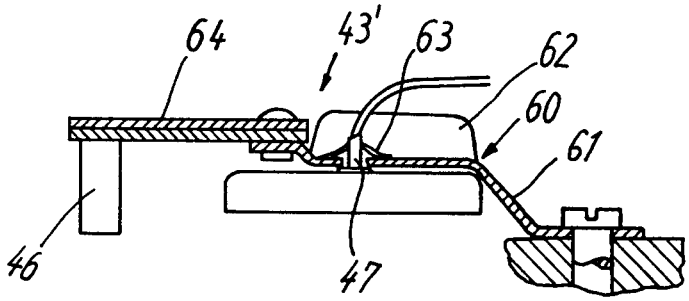

Further advantages and features of the invention will become apparent from the following description and the accompanying drawings showing preferred embodiments. In the drawings:

FIG. 1 is a central longitudinal section through a preferred embodiment of a temperature regulator according to the invention taken along the line I—I of FIG. 3;

FIG. 2 is a side view of the temperature regulator seen in the direction of the arrow II of FIG. 3, FIG. 3 is a plan view of the temperature regulator as seen in the direction of the arrow III of FIG. 1, FIG. 4 is a plan view seen from the same side as FIG. 3 but without the regulator portion which would be seen above the line IV—IV in FIG. 1, and FIG. 5 is a longitudinal section showing details of a variation of the embodiment of FIG. 1.

The temperature regulator 11 shown in FIGS. 1 to 4 has a switch housing 12 which is made from insulating material, for example, synthetic material or steatite, and has the form of a rectangular plate disposed perpendicular to a shaft 13. The shaft 13 forms an adjustment member for the temperature regulator and bears a setting button 14 shown by dash dot lines. In the axial direction of the shaft 13, the dimensions of the housing 12 are specifically less than in any other direction.

The side 15 of the housing 12 which is remote from the setting button 14 has two recesses 16,17. The shaft 13 projects through the recess 16. In this region it has a laterally bevelled form. Placed upon it is a switching cam 18 of a cam switch 19 (FIG. 4) which is disposed in the recess 16. The cam switch 16 includes contact springs 20,21 and corresponding opposite contacts 22,23, which springs and contacts, in the illustrated disconnected position of the cam switch, are separated from one another, but are connected over by far the greater part of the revolution of the shaft 13. For this purpose, respective cam surfaces of the switching cam and the corresponding tapping points of the switch springs are disposed at differing levels so that each spring is contacted only by the cam surface at one side of the cam. The switching springs lie laterally and perpendicular to the axial direction of the shaft 13 and the switching cams operate radially of the shaft 13. A construction having axial operating cams is also possible though the described arrangement is flatter when assembled.

The switching springs and the opposite contacts are made from bi-metallic strips and are fitted into slots 24, of the switch housing 12 and held on the operating side of the housing by bending or bracing. Provided for the contact springs 20,21 and the opposite contacts 22,23, are plug lugs such as lugs 25 which take the form of flat plugs and project from the housing part from the side 15 thereof. The shaft 13 projects through an adjusting nut 26 which co-operates with a left-hand thread 27 provided on the central portion of the shaft 13 for axial displacement of the shaft when the setting button 14 is turned. The adjusting nut 26 is held in position by a fixing bracket 28 which also enables the temperature regulator to be mounted on an installation shield (not shown) of an electrical cooking appliance. A stop plate 30 is disposed at the bottom of the recess 16, covered by an insulating plate 29, said stop plate being non-rotationally mounted, and with the shaft 13 determining the starting - and end - rotation positions of the shaft. The side of the housing 12 facing the operating button 14 is covered by an insulating plate 31 which covers line connections extending in that area.

Disposed in the recess 17 of the housing 12 is a snap switch 32 extending along the recess 17 almost over its entire length. The snap switch 32 has a snap spring 33 which has contacts 34 on both its ends. The contacts which lie below the snap spring in the view of FIG. 4, co-operate with opposite contacts 34' which are also disposed under the snap spring. Metal brackets 35 form counter stops which determine the contact spacing.

The snap spring 33 has cut-out spring tongues 36 which are aligned towards one another and are supported under initial stress on abutments 37 which are part of a base plate 38 fixed on the socket part 12. Current is supplied to the snap spring through the abutments 37, the base plate 38 and a terminal strip 39, which terminates in a terminal lug. The terminal lug 25 of the terminal strip 39 lies, as do all terminal lugs, parallel to the axial direction of the shaft 13 and projects beyond the rear side 15 of the housing 12.

Between the two abutments 37, which protrude through the spring tongue cut-outs, the snap spring 33 has a bridge carrying the actuation pressure member 40 of the snap switch.

Provided on the rear side 15 of the housing 12 is a regulator portion 41 formed by an expansion box 42 and a transmission lever 43. One end of the transmission lever is forked and is fixed with screws 44 on the housing 12 with an insulating plate 45 inserted therebetween. The transmission lever is bent upwards in the region of the fork. This portion of the transmission lever, which is made from highly resilient sheet metal, acts as a very powerful leaf spring by means of which the transmission lever, which is re-inforced by bending the sides down in its extension running otherwise parallel to the adjacent side of the socket part, is connected in a hinged manner to the socket part.

The end of the transmission lever opposite the fastening carries an insulating pressure member 46 which acts upon the pressure member 40 of the snap spring 33 disposed perpendicular to the longitudinal extension of the transmission lever.

Between the transmission lever 43 and the adjacent side of the insulating plate 45, the expansion box 42 is disposed directly adjacent to the transmission lever 43 and is fixed thereon. This is effected by a tubular, rivet like, connecting piece 47 (FIG. 1), which is welded or soldered on the upper diaphragm of the expansion box and in which a capillary tube 48 is soldered which forms the connection with a diagrammatically indicated thermometer probe 49 disposed in an opening in an electrical hot plate 50. The transmission lever is welded or soldered on the expansion box in the region of the connecting piece 47. As already described in the copending application, a tubular, rivet-like, part may alternatively be provided in addition which is placed over the connecting piece. This mode of connection with the capillary tube is preferably used in the present invention and is described in detail in the copending application the disclosure of which is incorporated herein by reference. The expansion box 42 has an unusually small diameter which, for example, in a hot plate automatic regulator, need only be 20 mm in length.

A ball pressed into the shaft 13 acts upon the hollow side of the capsule-like expansion box. It may be seen that owing to the leaf spring action of the transmission lever 43, a powerful contact pressure is permanently maintained between the shaft 13 and the expansion box 40 and between the pressure member 46 of the lever 43 and the pressure member 40 of the snap switch. Several contact points which could lead to falsification of the switch results are, however, absent. There is therefore a mechanical circuit which is force-lockingly closed and which permits switching substantially free of undesirable bouncing action.

It may be seen, particularly from FIGS. 2 and 3, that the regulator part 41 in the direction transverse to lever 43 is substantially narrower than the housing 12 and extends centrally and longitudinally of the housing 12 along its rear side and protrudes approximately by the height of the housing from this rear side. This regulator part may be covered by an insulating hood 51 shown by dash dot lines in FIG. 2. The necessary numerous plug terminal lugs such as 25 are disposed on the region of the rear side 15 of the housing 12, which lies outside the area of regulator part 41. The plug lugs, which are directed away from the side 15 of the housing, do not normally project at any point beyond the regulator part. As may be seen from FIG. 2, the installation height itself, considering the additional length of a plug 52 provided on a terminal line 53 and the bending radius of the line 53, is hardly greater than the construction height of the temperature regulator. The lines 53 may also be led away on both sides of the temperature regulator at any angle. The individual plug terminals such as 25 may be seen by comparing FIGS. 3 and 4. The plug terminals lying on the level on the expansion box on both lateral sides thereof come from the two contacts 34 of the snap switch 32 and are supported in recesses on the adjacent side of the housing. Double plug lugs, one for each terminal of the circuit, serve in addition to connect a signal line. One of the contact springs of the mechanical switch 19 is provided with the signal line contact of an electrical cooking appliance, whilst the other contact spring ensures separation of a pole of the mains from the relevant electrical hot plate in its disconnective state. The other pole is separated by the contacts 34.

It may be seen that the invention provides a temperature regulator having an extraordinarily low installation height, a very simple mechanism and electrical construction and a very exact mode of operation. The manner of operation of the two circuit regulator shown in the embodiment is obvious to the expert and requires no explanation.

FIG. 5 shows a modified detail of a temperature regulator, namely, the transmission lever 43' having an expansion box 42 and the pressure member 46 mounted thereon. The pressure member and the expansion box are identical to those in the previously described embodiment. However, the transmission lever 43' comprises a lever part 60 having a portion 61 which is fixed to the switch housing and is resilient so as to hinge with respect to its fixed end, and a portion which is reinforced by a bent-up edge 62 and on which the expansion box 42 is fixed, in that its terminal base 47, which is welded by an external flange on to the expansion box, projects through an opening and is fixed on the opposite side by a clamp guard ring 63. Such clamp guard rings comprise a flat spring steel ring having notches (for example 4 notches) to form spring lugs, which originate from its inner opening. Because the opening is smaller than the diameter of the terminal base 47, the plate is easily deformed conically in the manner of a cup spring and therefore forms a bar like fastening ring. Such fastening plates are described for example in the German Standard DIN 6797.

A relatively short-thick bi-metallic strip 64 adjoins the lever part 60 in the direction of the pressure member 46 and is so disposed to provide compensation for the ambient temperature.

Owing to the very small expansion box 42 and the very sensitive circuit of the temperature regulator according to the invention, the value of compensation may be very low because the temperature at the temperature regulator 11 only has a substantially smaller influence on the switch value than the temperature at the sensor feedbacks 49. It may be seen that there is no inadmissible elasticity in the transmission lever as a result of the short-thick bi-metallic strip.

We claim:

1. A temperature regulator for an electrical appliance, comprising: an expansion box, the expansion box being connectible to a temperature sensor such as to vary the pressure in the box with the temperature sensed by the sensor;

an adjustment member mounted to act on one side of the expansion box; a transmission lever mounted to be acted upon by the opposite side of the transmission box;

a snap switch located to be acted upon, to cause switching thereof, by said transmission lever on expansion and contraction of the expansion box;

the transmission lever extending closely over the expansion box;

a cam switch for mains or signal line connection, the cam of which is operated by said adjustment member;

and a switch housing;

said snap switch and said cam switch being mounted within a recess formed in the switch housing and open at the side thereof adjacent the transmission lever and the assembly formed by the expansion box and the transmission lever being of a height not substantially greater than the height of the housing and of a width in the direction transverse to the transmission arm substantially less than that of the switch housing.

2. A temperature regulator as claimed in claim 1, wherein said transmission lever comprises an opening lying on the axial line of expansion and contraction of the expansion box, and the expansion box comprises a tubular connector for connecting the expansion box to the temperature sensor by a capilliary tube; the tubular connector extending centrally into the expansion box and providing a portion extending through said opening in the transmission lever thus to fix the position of the expansion box with respect to the lever.

3. A temperature regulator as claimed in claim 1, in which electrical terminals for the switches are provided for the temperature regulator on the side of the housing adjacent the transmission lever in the area of that side of the housing not covered by said assembly of the expansion box and transmission lever.

4. A temperature regulator in claim 3, in which said terminals are male terminals.

5. A temperature regulator as claimed in claim 1, in which said switch housing comprises a separate recess for the snap switch and the cam switch respectively.

6. A temperature regulator as claimed in claim 1, wherein the snap switch comprises:

a elongate contact spring;

spring stops, one disposed towards each end of the contact spring;

spring abutment members disposed intermediate the spring stops; the spring comprising resilient tongues to abut on said abutment members respectively so that the spring is resiliently urged against said srping stops thus to locate the spring.

7. A temperature regulator as claimed in claim 6, wherein the snap switch spring comprises a central portion bearing a pressure member thereon for contact by one end of the transmission lever, and the snap switch comprises movable contacts carried by the spring and fixed contacts supported in the recess so that when the control portion of the spring is depressed by the action of the transmission lever on said pressure member, the movable contacts are moved into contact with the fixed contacts.

8. A temperature regulator as claimed in claim 1, wherein the adjustment member comprises a shaft extending into said recess and carries on the extending portion of the shaft the cam of the cam switch, and the housing comprises resilient contact arms disposed to flank the cam, and fixed contacts to oppose end contact portions of the resilient arms so that on rotation of the cam the contact arms are engaged by the cam to separate the contact end portions thereof from the fixed contacts and so that on further rotation of the cam when in engagement with the resilient arms, the cam disengages from the arms and permits the end contact portions of the arms to contact the fixed contacts.

9. A temperature regulator as claimed in claim 8, wherein the cam has stepped engagement surfaces and the resilient contact arms are disposed at different levels so that engagement of a resilient contact arm by the cam takes place only over a minor part of the rotation of the cam through one complete turn thereof.

10. A temperature regulator as claimed in claim 1, wherein the transmission arm comprises a bimetallic strip to compensate for ambient temperature changes.

11. A temperature regulator as claimed in claim 2, wherein the transmission arm bears spring lugs to contact the tubular connector when passed through said opening an hold it in position therein.

12. A temperature regulator as claimed in claim 1, comprising an electrically insulating cover for the assembly formed by the expansion box and the transmission lever.

* * * * *